US005738027A

United States Patent [19]

White

[11] Patent Number: 5,738,027

[45] Date of Patent: Apr. 14, 1998

[54] TUFTING PROCESS AND TUFTING DEVICE SUITABLE FOR IMPLEMENTATION OF THIS PROCESS

[75] Inventor: Derek White, Preston, Great Britain

[73] Assignee: Jos. Zimmermann GmbH & Co. KG, Aachen, Germany

[21] Appl. No.: 536,393

[22] Filed: Sep. 29, 1995

[30] Foreign Application Priority Data

Oct. 6, 1994 [DE] Germany ..... 44 35 723.0

[51] Int. Cl.[6] ..... D05C 15/24

[52] U.S. Cl. ..... 112/80.55; 112/475.23; 26/8 R

[58] Field of Search ..... 112/80.55, 80.56, 112/80.59, 80.5, 80.6, 475.01, 475.23; 26/8 R, 9; 83/956, 701; 156/73.2, 73.3; 82/904

[56] References Cited

U.S. PATENT DOCUMENTS

| | | | |
|---|---|---|---|
| 2,090,021 | 8/1937 | Baynton et al. | 112/80.59 |
| 4,541,349 | 9/1985 | Inoue | 156/73.2 X |
| 4,557,209 | 12/1985 | Watkins | 112/80.55 X |
| 4,864,904 | 9/1989 | Mishiro | 82/904 X |
| 5,345,885 | 9/1994 | Yoshino | 112/80.55 |

*Primary Examiner*—Peter Nerbun

*Attorney, Agent, or Firm*—Shook, Hardy & Bacon L.L.P.

[57] ABSTRACT

A tufting process is provided whereby one pile length is cut from a pile material which is to be joined to a backing material by means of a cutting edge after the formation of each loop. Provision is also made for the cutting process to be effected by means of the vibrational cutting movement of a cutting edge, in particular with the aim of improving the cut and reducing wear. In order to implement such a process, a tufting device is provided which incorporates a row of side by side loopers. The loopers move to-and-fro for the purpose of looping the pile material. Each looper includes a base installed in a looper block. A shaft extends from the block and has a nose for collecting the yarn on its front end. The shaft further incorporates a cutting edge configured so as to perform the cutting process. Each looper is adapted to be coupled with a vibrating drive which superimposes a vibrational motion on top of the to-and-fro motion.

13 Claims, 1 Drawing Sheet

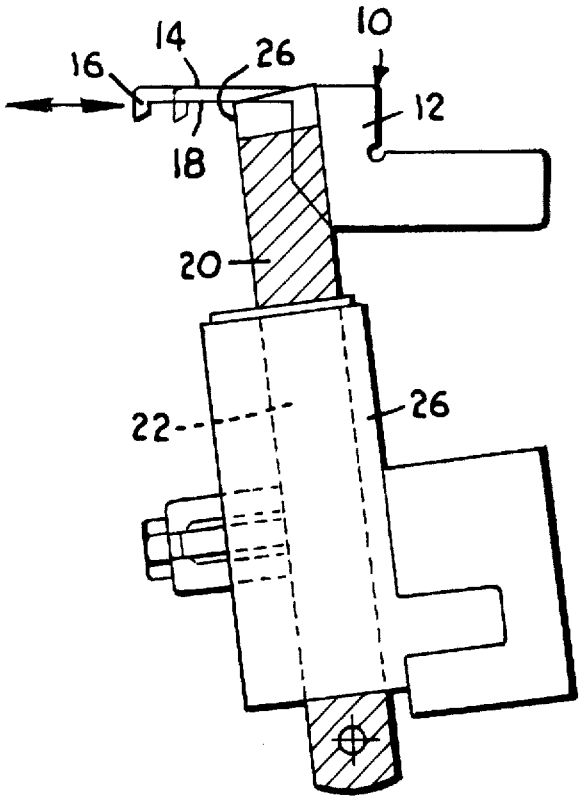
Fig. 1.
PRIOR ART
Fig. 2.
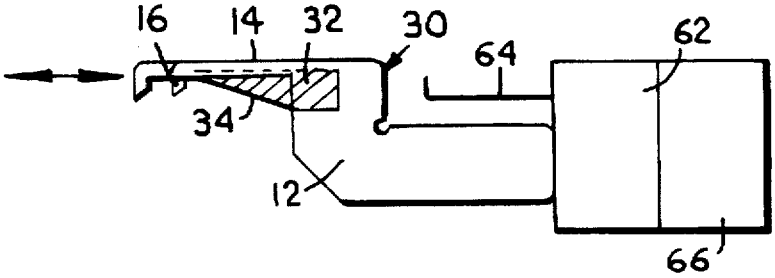
Fig. 3.
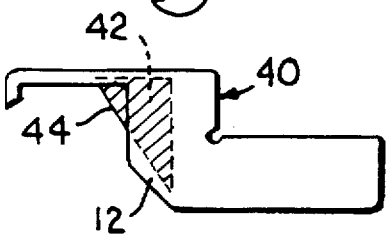
Fig. 4.
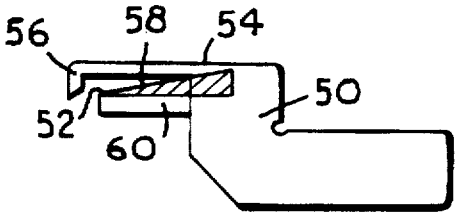

TUFTING PROCESS AND TUFTING DEVICE SUITABLE FOR IMPLEMENTATION OF THIS PROCESS

DESCRIPTION

The present invention concerns a tufting process whereby one pile length is cut from a pile material which is to be joined to a backing material by means of a cutting edge after the formation of each loop. The present invention further concerns a device suitable for implementation of such a process.

With a customary tufting machine which is employed to insert pile threads into a backing fabric, it is necessary to cut off the loops of the pile yarn after they have been pulled out of the backing fabric and while their loops are located on the respective loopers. An established process for cutting the loops on a looper incorporates a cutter which is mounted on the tufting machine in the vicinity of the looper and can be moved to and fro relative to the looper. In the course of this movement, the cutter performs a shearing cut with a cutting edge which is provided on the looper.

Considerable pressure is required to be exerted on the cutter in order to attain this cutting effect, particularly when the pile yarn has a high denier count. As a result, the pile yarn often undergoes an inclined, grinding J-cut, i.e. the yarn is drawn over the looper in the course of the cutting process, as a result of which the cut runs at an incline to the length of the yarn. This increases the quantity of pile yarn used, as all ends of the pile yarn which are cut with such a J-cut require subsequent recutting. The relatively high cutting pressure increases the wear on the cutting blades, which consequently require frequent replacement.

The object of the present invention is to avoid the above-described disadvantages, to specify an improved process for cutting the loops during the loop formation process which will substantially reduce the risk of J-cuts, and to create a suitable device for implementation of this process.

In accordance with the present invention, this object is attained with a process of the above-mentioned type by virtue of the fact that the cutting process is effected by means of a vibrational cutting motion of the cutting edge.

In order to attain the set objective, a device of the above-mentioned type is provided which is characterized by the fact that the cutting edge of the looper is configured to carry out the cutting process on its own and each looper can be coupled with a vibrating drive which superimposes a vibrational movement on the to-and-fro movement, or by the fact that each cutter can be coupled to a vibrating drive which superimposes a vibrational motion on the cutting stroke of the cutter.

Further embodiments of process and device constitute the subject of subordinate claims.

An important aspect of the invention with regard to the formation of pile loops in a pile fabric by means of a looper is that a cutting blade, which cuts off the loops of pile yarn collected by the looper, is subject to multiple short-stroke to-and-fro movements during the cutting process. This cutting process differs from the established shear cutting process in that, instead of one single cutting stroke (during which the blade(s) move(s) through the complete yarn), the blade performs a large number of short cutting strokes in the course of executing a single cut, as a result of which the blade cuts through the yarn in the manner of a sawing operation. As the blade cuts through only a small portion of the yarn during each to-and-fro stroke, it has been established that a lower cutting pressure is required than is the case when a single cutting operation is employed. The frequency of J-cuts is thus reduced.

It is expedient to generate the to-and-fro motions by vibrating the blade holder and, subsequently, the looper. It is expedient to subject the blade holder to high-frequency vibration, whereby "high-frequency" denotes a vibration frequency which is greater than the frequency of the to-and-fro motion which is employed for the established shear cutting process. Ideally, the blade should be moved at a vibration frequency of no less than 1,000 Hz (cycles per second).

This short-stroke, vibrational to-and-fro motion can be superimposed on the established shear cutting process or employed as an alternative to this process. The cutting device can thus be subjected to oscillation during execution of its cutting stroke. Alternatively, a cutting device can be employed which carries out a vibrational motion only in order to execute the cut.

In accordance with the present invention it is also possible to provide a looper for a tufting machine with a blade which cuts through the yarn collected by the looper. In this case, the blade should ideally be located in the area behind the nose of the looper.

In one embodiment of the present invention, the blade has a downward-sloping cutting edge which extends over most of the length of the looper's web. In this case, the cutting edge inclines downward from the nose.

In another embodiment, the cutting edge runs over the corner between the shaft and the base of the looper. In a further embodiment, the blade extends parallel to the shaft but below the same, whereby a gap through which the yarn can pass remains between the shaft and the blade. In this case, the cutting edge of the blade points upward and is upwardly inclined from the nose.

The blade may have a serrated cutting edge, as described in British patent application 8 135 929.

In accordance with the present invention it is possible, therefore, to vibrate the looper itself to and fro in order to attain the desired large number of short to-and-fro strokes of the blade. It has actually been established that it is possible to attain a correct cut of the pile yarn with a looper alone, without the use of a separate cutting device. This means that the cutting process which previously required the combined operation of a looper and a cutting device can now be replaced by the to-and-fro vibration of a looper fitted with a blade. This represents a considerable simplification of the process for forming pile threads.

The to-and-fro motion of the blade can be attained in various ways. In particular, it can be carried out via mechanical or electromechanical devices. A simple but effective method involves configuring the looper block, which bears a large number of loopers, in such a manner as to enable it to perform a to-and-fro movement. A cam is provided here, which moves the looper block to and fro so as to subject the loopers to a short to-and-fro movement of high frequency.

Alternatively, the looper block can be spring-loaded and subjected via a cam or hammer device to a rapid succession of knocks or blows, thereby inducing corresponding to-and-fro movements of the looper block.

Several embodiments of the tufting process in accordance with the present invention and a tufting process suitable for implementing this process are described below by reference to drawings.

FIG. 1 is a diagrammatic view of a prior art device which employs a looper in conjunction with a blade.

FIG. 2 shows a front view of a looper configured in accordance with the present invention.

FIG. 3 shows a view of a looper in accordance with the present invention similar to FIG. 2, with a different course of the cutting edge.

FIG. 4 shows a view of a looper in accordance with the present invention similar to FIG. 2, with another different course of the cutting edge.

Established tufting machines for manufacturing pile products or pile fabric incorporate a row of loopers, 10, as shown in FIG. 1. All of these loopers, 10, are arranged side-by-side in a looper block (not shown). The entire row of loopers, 10, extends over the entire working width of the machine. Each looper, 10, has a base, 12, a forward-pointing shaft, 14, which extends from this base, 12, and at the end of which is a nose, 16. The lower part of the shaft, 14, is ground on one side, in order to form a downward-pointing cutting edge, 18. As a tufting join is formed, the nose, 16, collects a loop of the tufting yarn and draws it out to the rear.

Each looper, 10, operates in conjunction with a cutting device, 20. Each cutting device, 20, has a blade, 22, which is installed in a cutter block, 24, whereby the number of cutters, 22, corresponds to the number of loopers, 10. Each cutter, 22, is provided with a blade, 26, at its upper end. The cutter block, 24, bearing the cutters, 22, can be moved up and down. For this purpose a drive (not shown) is provided, which moves the cutter block, 24, and the row of cutters, 22, installed in the cutter block, 24, up and down once in the course of one tufting cycle.

While the loop is held by the nose, 16, of the looper, 10, the cutter, 22, is held in a lowered position outside of the path of the loop formation process. After completion of this process, the cutter, 22, is moved upwards. At the same time, the looper, 10, moves back. As the cutting device is pressed laterally against the flank of the shaft, 14, of the looper, 10, the blade, 26, of the cutter, 22, exerts a shearing effect in conjunction with the cutting edge, 18, of the shaft, 14, as a result of which the loop is cut off, leaving two tuft joins in the fabric.

An established device of this type is well known, together with its mode of functioning and the attendant disadvantages, particularly with regard to the tendency towards so-called J-cuts.

In accordance with the present invention a looper block 62, in which the bases, 12, of loopers, 10, are installed, is configured in such, a manner that it can be induced to perform a to-and-fro vibrational motion. The means 66 to generate such vibrational motion have a cam drive and are configured in such a manner that the vibrational movements are several times faster than the to-and-fro movement of the looper block and, subsequently, of the loopers, 10, during the time interval of the machine cycle in which the cutter, 22, moves upwards in order to perform the cutting operation. The above-described shearing process is thus carried out here, too. However, a very fast to-and-fro movement of the looper and, in particular, of the cutting edge, 18, on the looper, 10, is superimposed on this process. The cutting process is thus improved substantially by a sawing effect of the cutting edge, 18. This, in turn, enables a reduction in the cutting pressure. As a result, the yarn is less inclined to be drawn during the cutting process. Consequently, the risk of J-cuts forming is reduced.

The vibrating drive is set, for example, at a frequency of at least 1000 Hz. As the cutting operation takes approximately 0.06 seconds, approximately 16 to-and-fro movements of the cutting edge, 18, provided on the looper, 10, are effected during the cutting operation of the cutter, 22.

FIG. 2 shows a looper, 30, whose base, 12, shaft, 14 and nose, 16, are configured in the customary manner, and which operates precisely in the customary manner for loopers, as far as the loop formation process is concerned. However, the flank of the shaft, 16, is not ground so as to form a cutting edge, 18; instead, a thin blade, 32, is provided here. The blade, 32, is similar to a razor blade, and is positioned in a recess which is located centrally in the middle of the width of the base, 12, and of the shaft, 14, of the looper, 30, in such a manner that it is supported by the metal on either side. The blade, 32, can also be embedded in a recess provided on a side of the base, 12, and the shaft, 14. As FIG. 2 shows, the blade, 32, has a cutting edge, 34, which extends from a position directly at the rear of the nose, 16, to the base, 12. The blade, 32, is inclined downwards towards the rear, that is, in the direction of the base, 12. The configuration of the blade, 32, in the looper, 10, is similar to the configuration of the blade of a cutter in the cut-pile weaving process. A row 64 of side by side loopers is schematically indicated in FIG. 2.

The looper, 10, shown in FIG. 2 could be employed in the device shown in FIG. 1, i.e. in conjunction with a cutting device, 20, and by means of oscillation or vibration of the looper.

It has been established, however, that it is also possible to use the looper, 10, shown in FIG. 2 without a cutting device, if this looper, 10, is oscillated or vibrated so as to move the blade, 32, to and fro. This means that it is possible to carry out a complete cutting operation with a looper configured in the described manner on its shaft in combination with high-frequency to-and-fro movement of the blade, 32, and the resultant sawing effect. It is consequently possible to omit the entire cutting device, resulting in an attendant substantial reduction in machine and maintenance costs, whereby the frequency of J-cuts is also reduced at the same time.

FIG. 3 shows a looper, 40, similar to that shown in FIG. 2, with the sole difference that the blade, 42, employed here is of a different shape and is fitted in a different position. In the case of the looper, 40, shown in FIG. 3 the blade, 42, is shorter and is installed on a vertical end face of the base, 12, of the looper, 40. The blade, 42, extends only over a short distance along the shaft, 14, as a result of which its cutting edge, 44, is vertical, rather than horizontal. This looper, 40, essentially operates in the same manner as the looper, 30, shown in FIG. 2, however.

FIG. 4 shows a more greatly differing form of a looper which is effective on its own, i.e. it is able to perform a cutting operation without interacting with a cutting device, 20. This looper has the same basic elements as the conventional looper, 10, but no ground side. A thin blade, 52, is provided. This blade, 52, extends forward in the form of a wedge from a base, 50, and ends directly behind the nose, 56. The blade, 52, runs underneath a shaft, 54, at a distance from the said shaft, 54; its cutting edge, 58, points upwards and rises towards the rear, that is, in the direction of the base, 50.

During formation of the tuft joins, the loop is able to pass between the nose, 56, and the front end of the blade, 52, to enable it to be collected by the nose, 56. The to-and-fro movement of the looper is then initiated, in order to effect cut-off of the loop, as in the above-described embodiments. In the last described embodiment, however, the yarn is cut from below. On practical grounds, a rib, 60, is provided along the bottom edge of the blade, 52.

List of reference numbers

10—Looper

12—Base

14—Shaft

16—Nose

18—Cutting edge

20—Cutting device

22—Cutter

24—Cutter block

26—Blade

30—Looper

32—Blade

34—Cutting edge

40—Looper

42—Blade

44—Cutting edge

50—Base

52—Blade

54—Shaft

56—Nose

58—Cutting edge

60—Rib

I claim:

1. A tufting process whereby one pile length used to form a plurality of loops is cut from a pile material by means of a cutting edge after the formation of each loop, wherein cutting of each loop is effected by a cutting procedure comprising:

moving the cutting edge to-and-fro during the cutting process; and superimposing a short-stroke vibrational motion on top of said to-and-fro movement of the cutting edge to thereby enhance the cutting operation.

2. A tufting process as set forth in claim 1, wherein said cutting edge is located on a looper which serves to draw in the yarn, and the cutting motion is carried out solely by the looper.

3. A tufting process as set forth in cIaim 1, wherein said cutting edge is located on a looper which serves to draw in the yarn, and the cutting motion is carried out by the looper in conjunction with a cutter blade.

4. A tufting process as set forth in claim 1, wherein said cutting edge is located on a cutter blade, and the cutting motion is carried out by the cutter-blade in conjunction with a looper.

5. A process as set forth in claim 1, wherein the vibrational cutting motion is performed at a frequency of 500 to 2,000 Hz.

6. A tufting process as set forth in claim 2, wherein the vibrational cutting motion is performed at a frequency of 500 to 2,000 Hz.

7. A tufting process as set forth in claim 3, wherein the vibrational cutting motion is performed at a frequency of 500 to 2,000 Hz.

8. A tufting process as set forth in claim 4, wherein the vibrational cutting motion is performed at a frequency of 500 to 2,000 Hz.

9. A tufting device comprising:

a looper block and a row of loopers arranged side by side and carried by said looper block, said loopers being movable to-and-fro for the purpose of looping the pile material, each said looper including a base installed in said looper block and a shaft, each said shaft including a shaft portion which extends from the base and a nose for collecting the yarn disposed in spaced relationship relative to said base, each said looper further including a detachable cutting blade mounted adjacent said shaft, which blade has a cutting edge that is inclined towards the direction of movement of the looper and which is configured so as to perform the cutting process on its own; and means for superimposing a vibrational movement to said loopers on top of said to-and-fro motion.

10. A device as set forth in claim 9, wherein said blade is attached to said shaft.

11. A device as set forth in claim 9, wherein said cutting edge runs along the shaft.

12. A device as set forth in claim 9, wherein there is a gap between said cutting edge and the shaft, and which gap narrows in a direction toward said base.

13. A device as set forth in claim 9, wherein said blade is attached to said base and projects from the base in the direction of said nose.

* * * * *